United States Patent [19]

Bügiel

[11] Patent Number: 4,590,861

[45] Date of Patent: May 27, 1986

[54] INSERT FOR A PROJECTILE-FORMING CHARGE

[75] Inventor: Horst G. Bügiel, Bonn-Ippendorf, Fed. Rep. of Germany

[73] Assignee: Diehl GmbH & Co., Fed. Rep. of Germany

[21] Appl. No.: 606,355

[22] Filed: May 2, 1984

[30] Foreign Application Priority Data

May 13, 1983 [DE] Fed. Rep. of Germany ..... 3317352

[51] Int. Cl.[4] ..... F42B 5/00

[52] U.S. Cl. ..... 102/501; 102/476; 102/307

[58] Field of Search ..... 102/475, 476, 306–310, 102/501

[56] References Cited

U.S. PATENT DOCUMENTS

| | | | |
|---|---|---|---|
| 3,235,005 | 2/1966 | Delacour | 102/306 |
| 3,732,816 | 5/1973 | Muller | 102/306 |
| 4,122,775 | 10/1978 | Held | 102/476 |

FOREIGN PATENT DOCUMENTS

| | | |
|---|---|---|
| 2913103 | 1/1980 | Fed. Rep. of Germany . |
| 1372142 | 8/1964 | France . |
| 1237392 | 6/1971 | United Kingdom . |

*Primary Examiner*—Harold J. Tudor

*Attorney, Agent, or Firm*—Scully, Scott, Murphy & Presser

[57] ABSTRACT

An insert for a projectile-forming charge with a non-constant or varying material thickness extending in the centripetal direction thereof. The insert incorporates peripherally mutually offset centripetally extending zones with a material thickness which is constant in the centripetal direction, and which alternates in transition with centripetally extending zones having a non-constant varying material thickness. In the interest of an improved combat effectiveness for large-caliber ammunition, notwithstanding greater target distances, through periodically varying the material thickness of the insert in the peripheral direction, during the folding in of the insert projectile there can be achieved a more stable flight trajectory due to the formation of defined stub wings at the tail end of the projectile.

10 Claims, 12 Drawing Figures

INSERT FOR A PROJECTILE-FORMING CHARGE

BACKGROUND OF THE INVENTION

1. Field of the Invention

The present invention relates to an insert for a projectile-forming charge with a non-constant or varying material thickness extending in the centripetal direction thereof.

2. Discussion of the Prior Art

A projectile-forming explosive charge insert of a known constructional type may be ascertained from the disclosures of German Laid-open Patent Application 29 13 103 and French Laid-open Patent Application 24 25 047. In order to propagate the course of the implosive deformation of the insert in a projectile which is directed against a target, provision has been made to allow for an increase in the material thickness from the center towards the area of the clamped bottom rim of the insert; in effect, to select an insert which possesses a non-constant material thickness extending in its centripetal direction.

It has been ascertained that such a type of configuration for an insert for calibers of average size still leads to favorable geometric relationships relative to the deformation properties of the insert and, as a result, to a projectile possessing a high penetrating force at distances of average magnitude. However, when the attacking distance of the projectile which is produced from the deformed insert is increased, there noticeably reduces the penetrating force in the target, which in particular can be traced back to the increasingly unstable aerodynamic characteristics of the projectile. When the projectile is formed from the insert for the explosive charge of a relatively large-caliber ammunition article, then this leads to a still more intensely adverse influence over the aerodynamic characteristics, inasmuch as the large mass of the thick bottom area of the insert which has a large circumference, leads to a geometrically almost unpredeterminable and uncontrollable imbalance; in effect, a completely non-uniform distribution of the flow resistances about the circumference of the projectile. Results have indicated that, on the basis of these conditions, at comparable target distances the larger caliber ammunition produces a poorer penetrating effect for the insert-projectile than smaller caliber ammunition, and that any aim of achieving an increase in the target distances is restricted within narrow bounds due to the increasingly unstable flight path with regard to the desired penetrating force in the target.

SUMMARY OF THE INVENTION

Accordingly, in recognition of these encountered conditions, it is an object of the present invention to so construct a projectile-forming explosive charge insert of the constructional type as set forth hereinabove, which during the course of its deformation will lead to the formation of a projectile which, even for larger caliber ammunition and at an increased target distance, will produce an improved penetrating effect in the target.

The foregoing object is inventively achieved in that the insert of the type described hereinabove incorporates peripherally mutually displaced or offset centripetally extending zones with a material thickness which is constant in the centripetal direction, and which alternates in transition with centripetally extending zones having a non-constant varying material thickness.

Such an insert, which is faceted in plan view and, namely, possesses a varying material thickness in the peripheral direction, in the interest of a defined implosion of the insert propagating from the center outwardly, allows for the utilization of relatively large masses at the base of the insert; whereas, on the other hand, the thickness variations in the circumferential direction cause predetermined centripetally-extending zones of the insert to be subjected earlier to their implosion-engengered folding in, and the thicker edge regions of the insert, after the folding in, are allowed to project in a star-shaped cross-sectioned configuration, such as stub wings, at the tail end of the projectile to thereby provide a favorable flow relationship. The faceted variation in the thickness of the insert material thus propagates the rapid formation of the projectile even notwithstanding the large diameter and the thicker insert base, but especially also a projectile configuration in a more favorable flow-enhancing geometry; in effect, enabling the firing of an insert projectile in a relatively stable flight trajectory, and thereby at a higher penetrating effect even after traversing relatively large distances to the target.

A projectile possessing these properties is not obtained with inserts with such types of configurations as are known from the above-mentioned publications showing such constructions; and from these publications there cannot be ascertained any suggestion that, in the interest of an improved combat effectiveness for large-caliber ammunition notwithstanding greater target distances, to also periodically vary the material thickness of the insert in the peripheral direction, whereby during the folding in the projectile there can be achieved a more stable flight trajectory due to the formation of defined stub wings at the tail end of the projectile.

This defined projectile guide mechanism-like folding in of the projectile tail section is occasioned through the periodically alternating material thickness in suitable areas of the metal plate of the insert.

It is essential for the wings which are produced at the tail end through the folding of the insert, that there are present generally centrally directed, differently thick zones of the metal thickness. The thinner zones form the roots or bases of the wings, whereas the thicker zones form the heads or edges of the wings. The distance of the thinner zones from the center of the insert determines the beginning of the wing section. The material thickness, in every instance, continuously increases and, namely, up to about 150% of the basic thickness; in essence, of the minimum material thickness.

The detonation wave propagation for the deformation of the metal plate within a projectile is predicated on usual measures, such as the multiple detonation of the explosive, inert material inserts, or hollow spaces in the explosive.

BRIEF DESCRIPTION OF THE DRAWINGS

Reference may now be had to the following detailed description of exemplary embodiments of the invention, taken in conjunction with the accompanying drawings; in which.

DETAILED DESCRIPTION

Figure 1A:
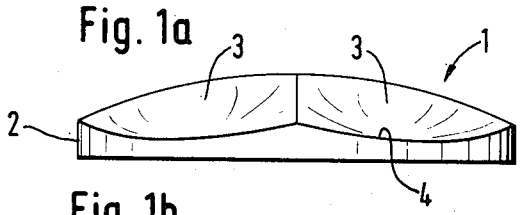
FIGS. 1*a* through 1*c* respectively illustrate, an end view, plan view, and sectional view through one embodiment of the inventive insert.
Figure 1C:
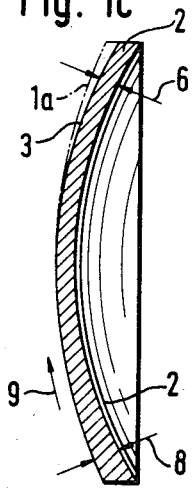
Figure 1B:
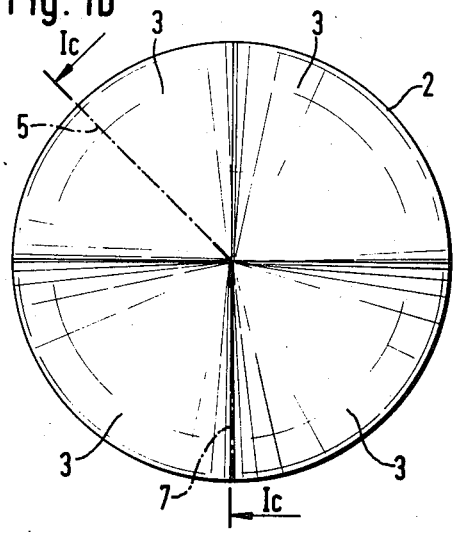

In accordance with FIGS. 1*a* through 1*c* of the drawings, there is illustrated an insert 1 in the shape of a spherically-curved dish 2. Due to concavely-curved indentation or depressions 3 formed in the convex side of the insert, the material thickness of the insert, viewed in the circumferential direction, extends in a wavilinear shape 4. In the zone 5, which concurrently represents the axis of symmetry for the indentation 3, the material thickness 6 is constant. In the zone 7 in which the two indentations 3 contact each other, the material thickness 8 reduces along the centripetal direction 9. Intermediate the zones 5 and 7, the material thickness reduces along the centripetal direction. The original insert without the worked-in indentation 3 is represented in FIG. 1*c* by a phantom line 1*a*.

Figure 2A:
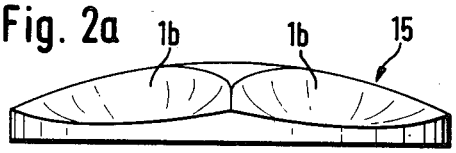
FIGS. 2*a* through 2*c* illustrate views similar to those in FIGS. 1*a* to 1*c* of a second embodiment of the insert.
Figure 2C:
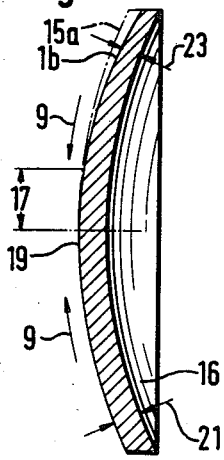
Figure 2B:
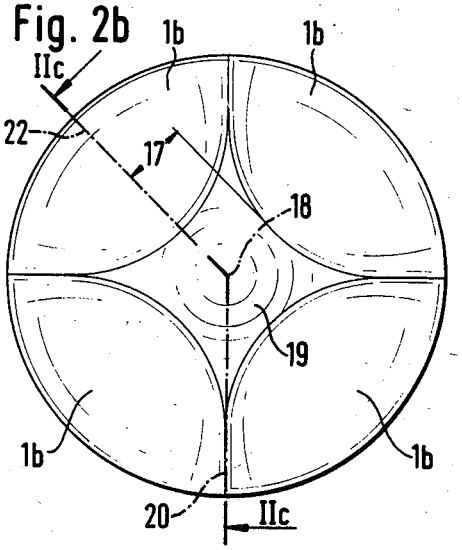

In accordance with the embodiment of FIGS. 2*a* through 2*c*, an insert 15 is formed as a spherically-curved dish 16. Concavely-curved indentations 1*b* formed in the convex side of the insert are located at a distance 17 relative to the center 18. The indentations 1*b* bound an area 19 possessing a uniform remaining material thickness. In one zone 20 the material thickness 21 remains uniform. In one zone 22 the material thickness 23 increases in the centripetal direction. The original shape and thickness of the insert is represented by a phantom line 15*a*.

Figure 3C:
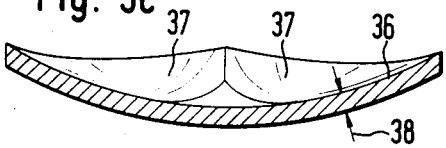
FIGS. 3*a* through 3*c* illustrate views similar to those in FIGS. 1*a* to 1*c* of a third embodiment of the insert.
Figure 3A:
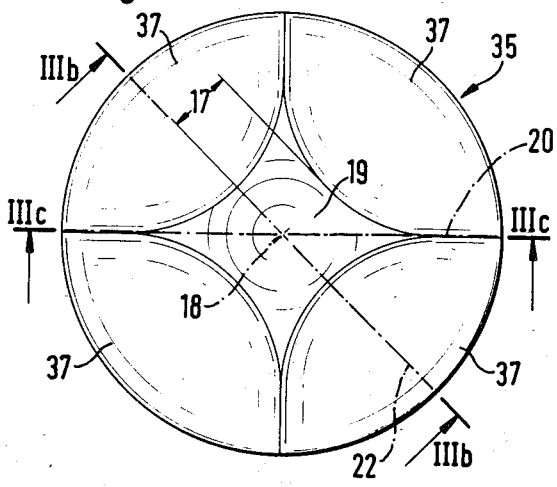
Figure 3B:
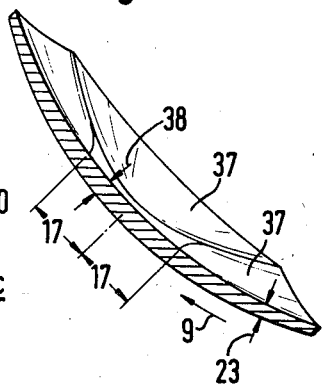

In accordance with the embodiment in FIGS. 3*a* through 3*c*, an insert 35 is formed as a spherically-curved dish 36. Indentations 37 formed in the concave side of the insert 35 are located at a distance 17 from the center 18 as is illustrated in FIG. 2*b*. The remaining features correspond with the features shown in the embodiment of FIGS. 2*a* through 2*c*. The original material thickness 38 of the insert 35 can be ascertained from FIG. 3*c*.

Figure 4A:
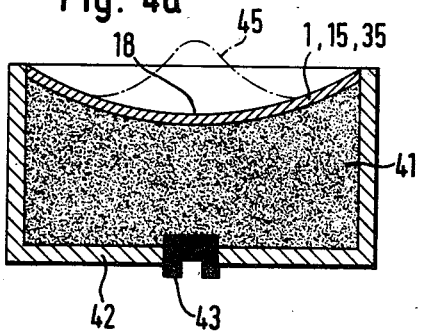
FIGS. 4*a* through 4*c* illustrate respective stages in the deformation of an insert into a projectile from an initial condition into a final condition.
Figure 4B:
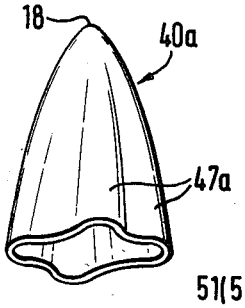
Figure 4C:
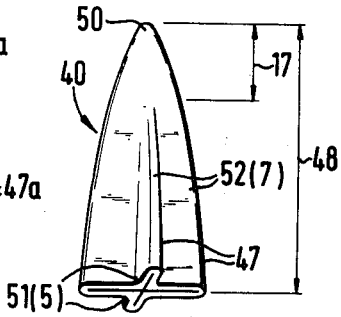

Referring to FIGS. 4*a* through 4*c* of the drawings, there is illustrated in two steps (FIGS. 4*b*, 4*c*) the production of an explosive material-formed projectile 40 from either the insert 1, 15 or 35. The above-mentioned insert constituted of a suitable material is arranged together with an explosive charge 41 in a housing 42 having a detonating device 43. Upon the triggering of the explosive charge 41, the insert 1; 15; or 35, is deformed into a hat-like shape (phantom line 45) and is imparted the interim form 40*a*, as shown in FIG. 4*b*, with preformed wings 47*a*.

In accordance with FIG. 4*c*, the projectile 40 is finish-shaped with the wings 47. The wings 47 extend somewhat beyond two-thirds of the length 48 of the projectile 40 from about the distance 17 from the earlier center 18, which is now the projectile tip 50. The zones 5 each form the base or root 51 of the wings 47. The zones 7 form the head or edges 52 of the wings. In addition to the described embodiments there can also be utilized other shapes for the inserts, such as conically-shaped inserts. The geometry of the basic configuration of the insert is as may be suitable; for instahce, a spherically-dished element with a flat cone, or a combination of flat cone and spherically-dished element. Moreover, it is also possible to employ a degressive or progressive basic shape. The projectile, with a respective number of zones having different material thicknesses, can possess three, four, six or eight wings.

What is claimed is:

1. A projectile-forming, explosive-charge insert comprising:

a spherically-curved, generally dish shaped insert body having a non-constant material thickness extending in the centripetal direction;

said insert body including mutually peripherally displaced, centripetally extending first zones each having a constant material thicknesses in the centripetal direction; and further centripetally extending second zones each having a non-constant thickness alternating with and forming transitions with said first zones.

2. Insert as claimed in claim 1, wherein said alternating zones form a faceted configuration through centrally directed, uniformly arranged indentations.

3. Insert as claimed in claim 2, wherein said faceted configuration is formed through concavely flatly curved indentations arranged about the circumference of said insert, said indentations contacting along their sides.

4. Insert as claimed in claim 1, wherein said zones are formed by indentations contacting each other at the center of said insert.

5. Insert as claimed in claim 1, wherein said zones are formed by indentations having inner edge regions located at a distance from the center of the insert.

6. Insert as claimed in claim 1, wherein the material thickness along the circumference of said insert increases and decreases wavilinearly in the region of the indentations.

7. Insert as claimed in claim 1, wherein said indentations are formed on the convex side of the insert.

8. Insert as claimed in claim 1, wherein said indentations are formed on the concave side of the insert.

9. Insert as claimed in claim 1, wherein the material thickness increases centripetally up to a central region which possesses a constant material thickness.

10. Insert as claimed in claim 1, wherein the faceted configuration is formed by eccentrically oriented and uniformly arranged cross-sectional weakenings in said insert.

* * * * *

UNITED STATES PATENT AND TRADEMARK OFFICE

CERTIFICATE OF CORRECTION

PATENT NO. : 4,590,861

DATED : May 27, 1986

INVENTOR(S) : Horst Georg Bugiel

It is certified that error appears in the above-identified patent and that said Letters Patent is hereby corrected as shown below:

Claim 3, line 2: delete --"flatly"--

Signed and Sealed this

Thirty-first Day of March, 1987

*Attest:*

DONALD J. QUIGG

*Attesting Officer*

*Commissioner of Patents and Trademarks*